US007631728B2

(12) United States Patent
Hill et al.

(10) Patent No.: US 7,631,728 B2
(45) Date of Patent: Dec. 15, 2009

(54) SAFETY HARNESS

(75) Inventors: Christopher Ross Hill, Romsey (GB); Rodney James Capel Hogg, Brook (GB); Christophe Chedal Anglay, Cran Gevrier (FR)

(73) Assignee: Spinlock Ltd. (GB)

( * ) Notice: Subject to any disclaimer, the term of this patent is extended or adjusted under 35 U.S.C. 154(b) by 648 days.

(21) Appl. No.: 11/099,209

(22) Filed: Apr. 5, 2005

(65) Prior Publication Data

US 2005/0263347 A1 Dec. 1, 2005

(30) Foreign Application Priority Data

May 14, 2004 (GB) ..... 0410849.4

(51) Int. Cl.
*A47L 3/04* (2006.01)

(52) U.S. Cl. ..... 182/3

(58) Field of Classification Search ..... 441/106, 441/113; 182/3

See application file for complete search history.

(56) References Cited

U.S. PATENT DOCUMENTS

| | | | | |
|---|---|---|---|---|
| 2,661,888 | A * | 12/1953 | Sidlinger | 182/3 |
| 3,362,034 | A | 1/1968 | Oldham | |
| 4,936,805 | A * | 6/1990 | Piatt, Jr. | 441/106 |
| 5,145,027 | A | 9/1992 | Petzl et al. | |
| 5,203,829 | A | 4/1993 | Fisk et al. | |
| 5,692,933 | A | 12/1997 | Bradley et al. | |
| 6,106,348 | A | 8/2000 | Loisel | |
| 6,179,677 | B1 * | 1/2001 | Dornier | 441/113 |
| 6,270,386 | B1 | 8/2001 | Visocekas | |
| 6,422,513 | B1 | 7/2002 | Lewis et al. | |

FOREIGN PATENT DOCUMENTS

| | | |
|---|---|---|
| CA | 2293942 | 5/2001 |
| EP | 0 477 110 A | 3/1992 |
| EP | 05 25 2133 | 8/2007 |
| FR | 2783232 | 3/2000 |
| GB | 689597 | 4/1953 |
| GB | 974117 | 11/1964 |
| GB | 1 249 495 | 10/1971 |
| GB | 2 273 645 A | 6/1994 |
| GB | 0410849.4 | 8/2004 |
| GB | 0410849.4 | 2/2005 |
| WO | WO 99/42063 A | 8/1999 |

* cited by examiner

*Primary Examiner*—Stephen Avila
(74) *Attorney, Agent, or Firm*—Wall & Tong, LLP

(57) ABSTRACT

A safety harness comprising an inner support loop contactable with the chest area of a wearer when worn. The inner support loop is continuous and has at least one resilient section. An outer load bearing strap is fixed to the inner support loop. The outer strap has at least one fastener fixed to it. A section of the outer strap and the fastener are engageable with each other such that a second continuous loop is formed. When the outer strap and fastener are engaged the size of the inner and outer loops are adjustable to fit the wearer.

1 Claim, 11 Drawing Sheets

SAFETY HARNESS

CROSS-REFERENCE TO RELATED APPLICATION

This application claims priority from Great Britain 04 10849.4 filed on May 14, 2004.

FIELD OF THE INVENTION

The present invention relates to safety harness and improvements thereof. Embodiments of the present invention relate to marine harnesses, in particular, deck harnesses.

BACKGROUND OF THE INVENTION

It is well known that deck harnesses are provided on boats and ships for safety whilst on deck. A deck harness facilitates the attachment of the wearer to a strongpoint, for example a jackstay by means of a tethering line or strop whilst on deck. It is common that many mariners consider the use of a deck harness to be uncomfortable and restrictive and more particularly they find such harnesses difficult to don and adjust. As a result, many disregard the hazards associated with not wearing the harness and choose not to wear them whilst on deck or postpone donning at risk to themselves until conditions worsen and donning is more difficult. Furthermore, as the means of adjusting a typical known harness can be difficult and slow to use, in lively weather, users may incorrectly adjust the harness or fit it wrongly resulting in greatly reduced protection of the user.

SUMMARY OF THE INVENTION

It is an object of the present invention to provide an improved safety harness, one that provides safety, comfort and ease of donning and adjustment to the wearer. Such benefits would encourage users to wear safety harnesses at all times whilst on board a vessel.

Accordingly, one aspect of the present invention provides a safety harness comprising an inner support loop contactable with the chest area of a wearer when worn, the inner support loop being continuous and having at least one resilient section, an outer load bearing strap fixed to the inner support loop, the outer strap having at least one fastener fixed thereto, a section of the outer strap and the fastener being engageable with each other such that a second continuous loop is formed, when engaged with each other the outer strap and fastener facilitate adjustment of size of the inner loop to fit the wearer.

The continuous inner support loop having at least one resilient section provides ease of donning of the safety harness, and provides an approximate fit of the harness to the wearer. Once the harness is donned the outer strap and fastener provide more exact, and simpler, adjustment of the harness to fit the wearer.

Safety harnesses must be certificated. To meet certification requirements a deck harness should provide continuous contact around the torso of the wearer, usually about the chest area. Certification of deck harnesses requires a belt/loop to provide continuous contact. An embodiment of the present invention comprises an inner loop having at least a width of 45 mm to fit the wearer with the recommended continuous contact, in accordance with international standard ISO/FDIS 12401:2004, EN 1095, wherein a minimum width of 45 mm is specified for a size 1 harness, applicable to a body mass of greater than 50 kg.

The resilient member makes donning the safety harness easier. Therefore, when the harness has been adjusted to fit the wearer the resilient member is made effectively redundant, that is to say that no load is carried by the resilient member due to the continuous contact with the adjusted inner support loop. Suitably, the inner support loop comprises a front section and a rear section. Suitably, the at least one fastener is located on the front section. In an embodiment, there are two fasteners located on the front section; one disposed each side of the centre of the front section. In an embodiment, the two fasteners are located at each side of the wearer's torso.

In a preferred embodiment, the front section and rear section partially overlap each other. Overlapping of the front section and rear section ensures that continuous contact about the wearer's torso is achieved. Preferably, a tunnel is provided which guides the front and rear sections into overlapping contact.

In an embodiment, the front and rear sections are linked by at least one elasticated section. The elasticated section(s), in an unstretched state, hold the front and rear sections with a predetermined amount of overlap.

Suitably, the harness has an anchoring point on at least one of the front section or rear section. The anchoring point provides a connection point for a lifeline to ensure the safety of the wearer whilst on deck. Suitably, the anchoring point is located substantially central of the front section. Suitably, the anchoring point is an integral part of the outer strap.

By wearing the safety harness the wearer also benefits from being retained on the working deck of the vessel and prevented from falling into the water and in the event where the wearer has fallen into the water assisting recovery of the wearer back onto the working deck.

An embodiment further comprises a pair of thigh straps. Each thigh strap suitably forms a loop around the thigh of the wearer when worn. The thigh strap advantageously acts as a retainer to prevent ride-up of the safety harness, when worn.

Each thigh strap may comprise adjustment means. The adjustment means facilitates, fitting the thigh strap comfortably tightly around the thigh and/or positional adjustment on the thigh to improve comfort for the wearer compared to conventional crutch-type straps.

Alternatively, another embodiment comprises a pair of leg straps attached to the harness. The leg straps support the wearer to support full load of the wearer whilst working aloft, for example on the mast of a vessel. The width of at least part of the leg strap is wider than the thigh strap. The wider section of the leg strap may be wider than that of the thigh strap. The wider section of the leg strap provides a contact surface with the back of the wearer's thigh that improves comfort for the wearer and prevents "dead leg".

Each leg strap may be connected to the other. Each leg strap comprises a first strap section attached to the rear section of the harness and a second strap section attached to the front section of the harness. The second strap section may be provided with a loop, which is attachable to the anchoring point of the harness. The second strap section may connect the pair of leg straps together.

Each leg strap may comprise adjustment means. The adjustment means facilitate adjustment of the leg strap around the wearer's thigh.

Each leg strap may include a removable cover. The removable cover may be an anti-abrasion cover such that each leg strap is protected from damage whilst the wearer is sitting on deck.

A safety harness having the leg straps as herein described may be used as a mast harness.

Suitably, the safety harness further comprises a yoke strap, integrally connected with the front section and connected to the rear section by an adjustment means. The yoke strap is worn around the wearer's neck and supports the harness on the wearer's shoulders. The adjustment means facilitates adjustment of the distance between the yoke strap and the rear section to ensure an optimum fit for the wearer.

Suitably, connection of the adjustment means to the yoke strap is provided by a loop. Suitably, connection of the adjustment means to the rear section may be provided by a loop. Connection of the adjustment means to the rear section may be provided at two locations, spaced apart and substantially equi-spaced about the centre of the rear section.

Suitably, the adjustment means is provided by a strap and fastener arrangement. The strap and fastener arrangement may be similar to that forming the continuous outer loop. Suitably, the strap of the adjustment means is located at one of the said locations on the rear section and the fastener of the adjustment means is located at the other of the said locations on the rear section.

Connection of the adjustment means with the yoke strap, and the two locations on the rear section may provide an inverted V configuration. Suitably, the inverted V configuration is provided by the strap of the adjustment means extending from one said location at the rear section and passing through the loop at the yoke strap to connect with the fastener of the adjustment means provided at the other said location on the rear section.

The safety harness may also include a flotation aid, either as an integral part or in combination. The flotation aid is suitably provided by a life jacket. In a normal state a life jacket is deflated and housed in a suitable cover. Manual and/or automatic inflation of the life jacket is activated usually on contact with water.

The yoke may provide a housing, within which may be housed a life jacket. The housing may have an aperture communicating with the interior of the housing, and a handle. Suitably, the handle and the housing have complementary attachment means, which attach the handle to the housing. The attachment means are preferably adjacent the aperture.

The safety harness may be used in combination with a life jacket housed in, and attached to the harness by, a cover.

The safety harness of the present invention in combination with a life jacket is advantageous because there is a greater likelihood that the user will correctly fit and adjust the harness and thus increase the effectiveness of the life jacket. Another aspect of the invention provides a cover for a lifejacket, the cover having two integrally connected arms forming a generally U-shaped cover, the cover having means for attaching to the harness of said one aspect.

In a conventional life jacket and cover there is a toggle connected by a string to a trigger of an actuator of the life jacket. The toggle is small and difficult to find in an emergency. The toggle hangs from the free end of one of the arms of the cover. It sometimes snags on equipment inflating the life jacket. Users may place the toggle inside the cover to prevent this at danger to themselves.

A further aspect provides a cover for a lifejacket, the cover having two integrally connected arms forming a generally U-shaped cover, the cover having in one of said arms an aperture communicating with the interior of the cover, the aperture being in a predetermined position spaced from the end of the arm, and a handle, the handle and cover having complementary attachment means for attaching the handle to the cover, the attachment means on the cover being adjacent the aperture. Preferably, the cover has a pocket over the aperture, the pocket having a opening along the inner edge of the arm, the handle being held in the pocket by the attachment means but slightly protruding from the pocket at the said opening. Preferably the handle is at the inner edge of the arm. Preferably the handle is parallel to the inner edge. Thus the further aspect provides a handle for actuating the trigger of an actuator of a life jacket. The handle is easy to locate in an emergency because of its size and it is attached to the arm of the cover in a predetermined position spaced from the free end of the arm. Preferably the handle is positioned at about the chest of the user in use of the cover. The pocket protects the handle. Also positioning the handle adjacent to and parallel to the inner edge of the cover protects the handle from accidental use and makes it easier to locate.

Another aspect of the invention provides a safety harness comprising: an inner support loop contactable with an area of the body of a wearer between the waist and the chest when worn, the inner support loop having at least one resilient section: an outer load bearing strap fixed to the inner support loop; at least one fastener for connecting two adjacent sections of the outer strap, the at least one fastener being operable to facilitate adjustment of size of the inner and outer loops to fit the wearer: the fastener, and the outer strap together forming a continuous loop when the fastener connects the said two adjacent sections, and the inner loop being effectively a complete loop around the body of the wearer.

BRIEF DESCRIPTION OF THE DRAWINGS

This allows the harness to be donned in the manner of a jacket and provides the benefits of said one aspect.

Embodiments of the invention will now be described, by way of example only, with reference to the accompanying schematic drawings, in which:

FIG. 5(*a*) shows a guiding tunnel section, FIG. 5(*b*) shows overlapping arrangement of the front and rear section with the tunnel section removed for clarity, and FIG. 5(*c*) shows the outer surface of the tunnel section having stowing means for stowing excess strap;

FIG. 6(*b*) is a top view of the front section of the harness;

Throughout the figures like reference numerals are used to refer to like features.

DETAILED DESCRIPTION OF THE DRAWINGS

Figure 1A:
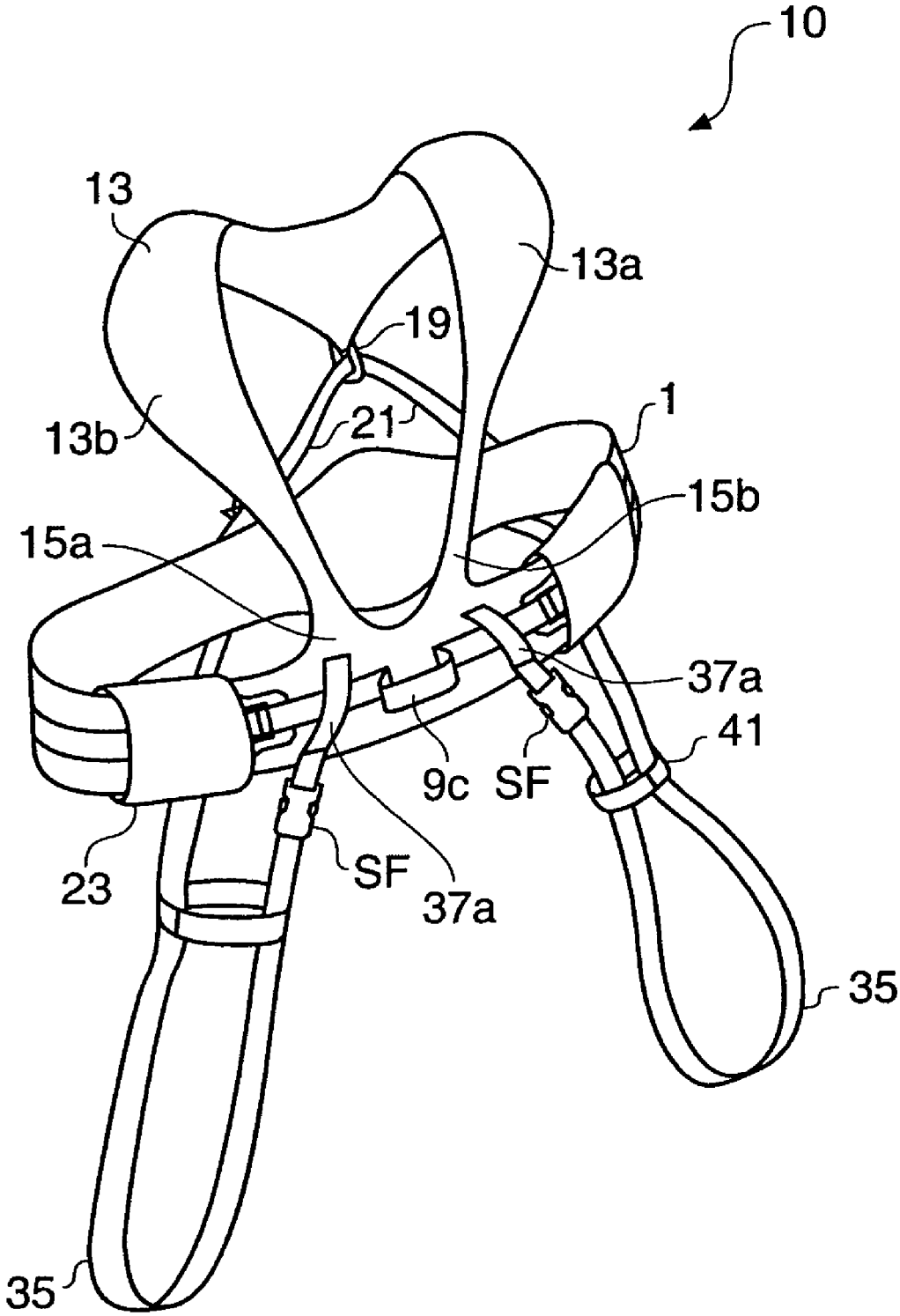
FIG. 1*a* illustrates a deck harness with thigh straps attached.

Referring to FIGS. 1*a* to 3, in one embodiment the present invention provides a deck harness 10, which comprises a chest belt 1 formed of two parts; namely a front section 3 and a rear section 5. The front section 3 and rear section 5 each comprise two parts; namely an inner portion 7 and an outer portion 9. The inner portion 7 has a minimum width of 45 mm. The front section 3 of the inner portion 7 as shown in the figures has a minimum width of 50 mm at its narrowest part; namely, at the ends thereof. Generally, a width of 70 mm applies over the major part of the front section.

The rear section 5 of the inner portion 7 as shown in the figures has a width of generally 50 mm increasing to a maximum of 95 mm about the central section.

The inner portion 7 is shaped to fit comfortably against the human body. At the rear section 5 it is shaped to provide a larger contact surface 11 in the region of the spine to provide added comfort to the wearer.

The front section 3 is formed with an integral yoke 13, having two shoulder straps 13*a* and 13*b* and which passes over the head of the wearer and is supported on the shoulders. The transition from chest belt 1 to each shoulder strap is in a delta formation 15*a*, 15*b*. Each delta formation is a generally triangular transition. The two delta formations 15*a*, 15*b* space apart the connections of the shoulder straps 13*a*, 13*b* to the chest belt to provide a comfortable fit for the user. The delta formations allow the shoulder straps to connect to the chest belt 1 at a three-way connection at desired angles to provide a comfortable fit for the user.

The inner portion 7 of the front section 3 and the yoke 13 may be manufactured as one or more pieces. They have a padded form with breathable material forming the inner surface, which is in contact with the body of the wearer when worn, and substantially water repellent and/or abrasion resistant material forming the outer surface. A preferred form of the material is a laminate having a closed cell foam core laminated on one side with the breathable material and laminated on the other side with the abrasion resistant material. The entire piece is edged with fabric edging material 17, which provides much of the strength of the yoke whilst also providing a radiused softer edge to the harness. The edging 17 at the yoke section 13 extends to form a loop 19 through which a strap 21 passes to facilitate adjustment to the rear of the deck harness when worn.

Figure 2:
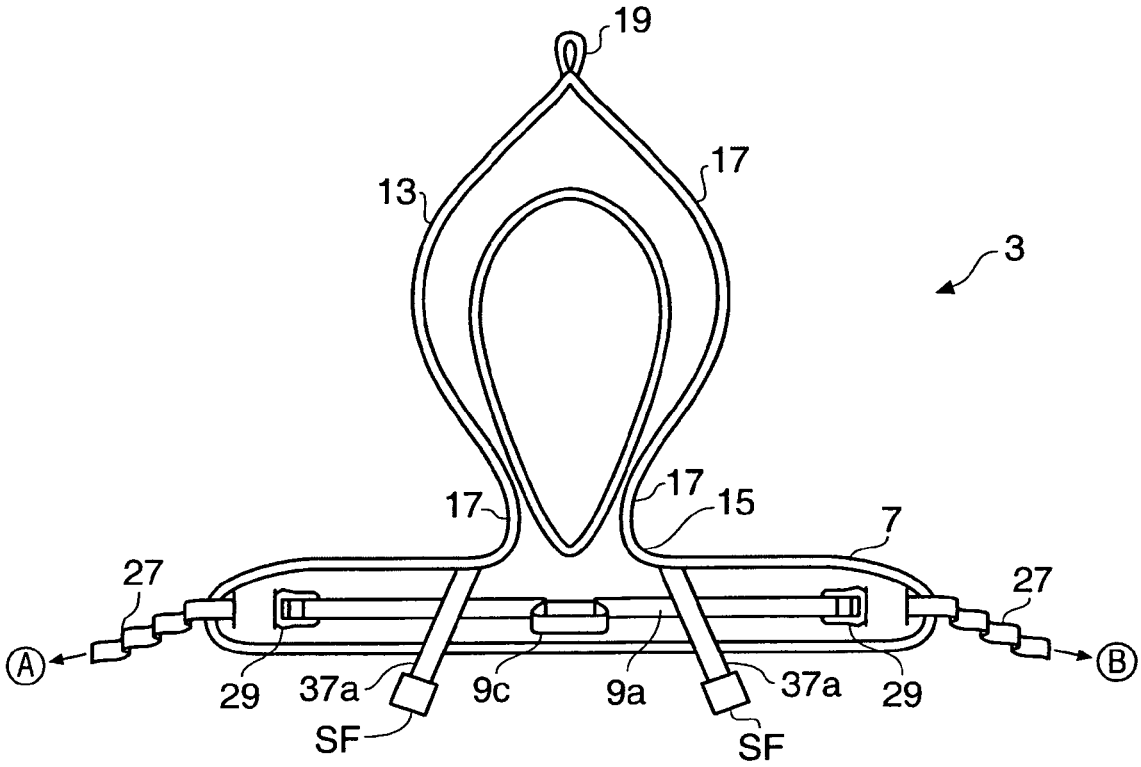
FIG. 2 illustrates a front section of the deck harness of FIG. 1*a;*

As best shown in FIG. 2, each shoulder strap is connected to the delta formation of the chest belt by the edging material 17, which bears the required load. Alternatively, the yoke may be connected to the chest belt 1 by suitable fasteners, for example snap-fit fasteners.

A tether attachment 9C is at the front centre of the chest belt. The front section further comprises a tunnel section 23 (see FIGS. 1 and 5), which acts as a guide to bring the front 3 and rear section 5 into overlapping contact when adjusting the chest belt 1 to fit the wearer. The tunnel section 23 also prevents twisting of the chest belt 1 during donning. As shown in FIG. 1 there are two tunnel sections, one at each side of the harness. The tunnel sections may be of elasticated material.

Figure 5A:
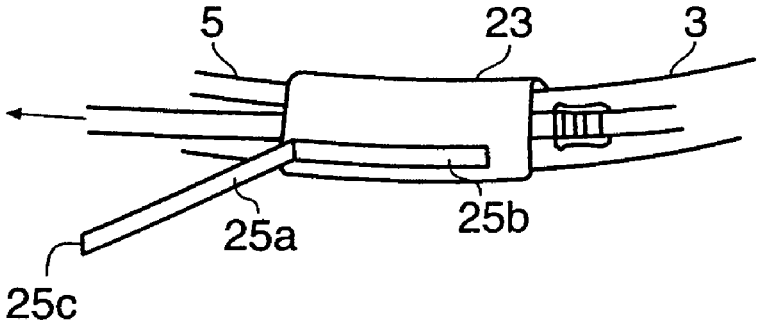
FIG. 5 illustrates the fastener and strap arrangement providing adjustment of the inner loop of FIG. 4.
Figure 5B:
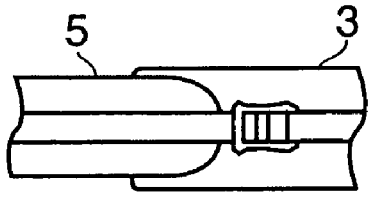
Figure 5C:
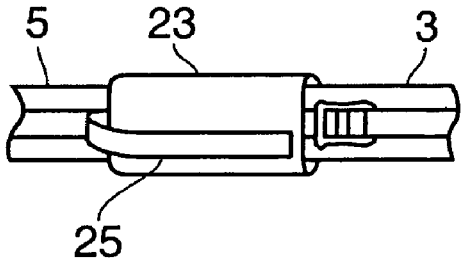

The tunnel sections may be used to stow a tether when it is not deployed to attach the user to the boat. Alternatively, on the outside surface of one or both tunnel sections 23, stowage means 25 may be provided to hold the tether to one side of the user when deployed and the user needs to use equipment, for example a winch. By holding the tether to one side the tether is held away from the equipment. The stowage means 25 may be in the form of a secondary tunnel. Preferably, as shown in FIG. 5, a hook and loop fastening tape 25*a*, 25*b* is attached to the outer surface of the tunnel section 23. In this example the loop material 25*a* is fixed to the tunnel. The hook material 25*b* is fixed to the tunnel at the end of the material 25*a* remote from the tether attachment 9*c* and is longer than the loop material. This provides space to hold the tether and also ensures the tether releases easily from the hook and loop material in an emergency because pull on the tether is in a direction towards the free end of the hook material.

Figure 4:
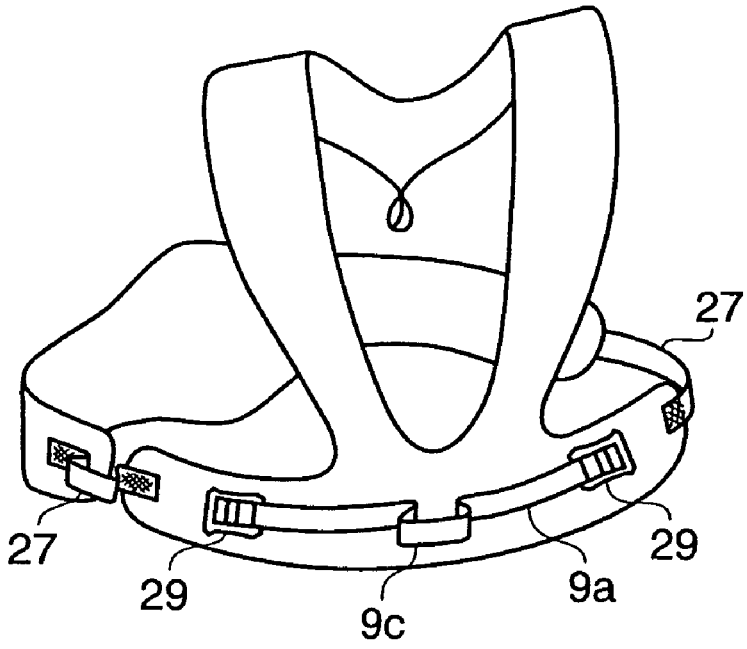
FIG. 4 shows connection of the front and rear sections of FIGS. 2 and 3 to form an inner loop.

Elastic straps 27 (see FIGS. 2 and 4) join together the front 3 and rear 5 sections of the inner portion 7 to form a continuous loop. The elastic straps 27, in their unstretched state, hold the front 3 and rear 5 sections in overlapping relation. On donning, the elastic straps 27 yield to increase the size of the inner loop, thereby easing donning of the deck harness 10.

The outer portion 9 is provided by fabric strap 9*a*, 9*b* attached to the outer surface of the inner portion 7. The strap is of webbing of any suitable material. Preferably the webbing is of polyester.

At the rear section 5 the fabric strap 9*b* extends from both ends towards the front section 3. At the centre of the front section 3 the strap 9*a* is adapted to provide the loop 9*c* to which a tether (not shown) may be attached. Additionally, at the front section two fasteners 29 are fixed to the strap 9*a*, each being disposed about the centre and being connectable with the straps 9*b* extending from the rear section 5. As best shown in FIG. 6(*b*), the front strap 9*a* is in the form of a loop stitched to the front inner portion 7. The ends of the strap 9*a* overlap and are stitched to the inner portion 7 at the centre thereof. The fasteners 29 are held by loops formed by the strap 9*a*. The tether attachment loop 9*c* is an integral part of the strap 9*a*. Connection of the rear section straps 9*b* via the fasteners 29 to the front strap 9*a* provides a continuous outer loop, which is a load bearing loop, and facilitates adjustment of the chest belt 1 of the deck harness 10 to fit the wearer.

An additional strap 21 and fastener 33 arrangement at the rear of the deck harness 10 provides adjustment of the distance between the yoke 13 and the rear section 5 to fit the wearer. The combination of strap 21 and fastener 33 forms an inverted V. Two straps 21, 31 are fixed to the rear section, each being disposed about the centre. One strap 21 extends from the rear section 5 and passes through the loop 19 at the yoke 13 to be connected with a fastener 33 affixed to the free end of the other strap 31.

Thigh Straps

Figure 1B:
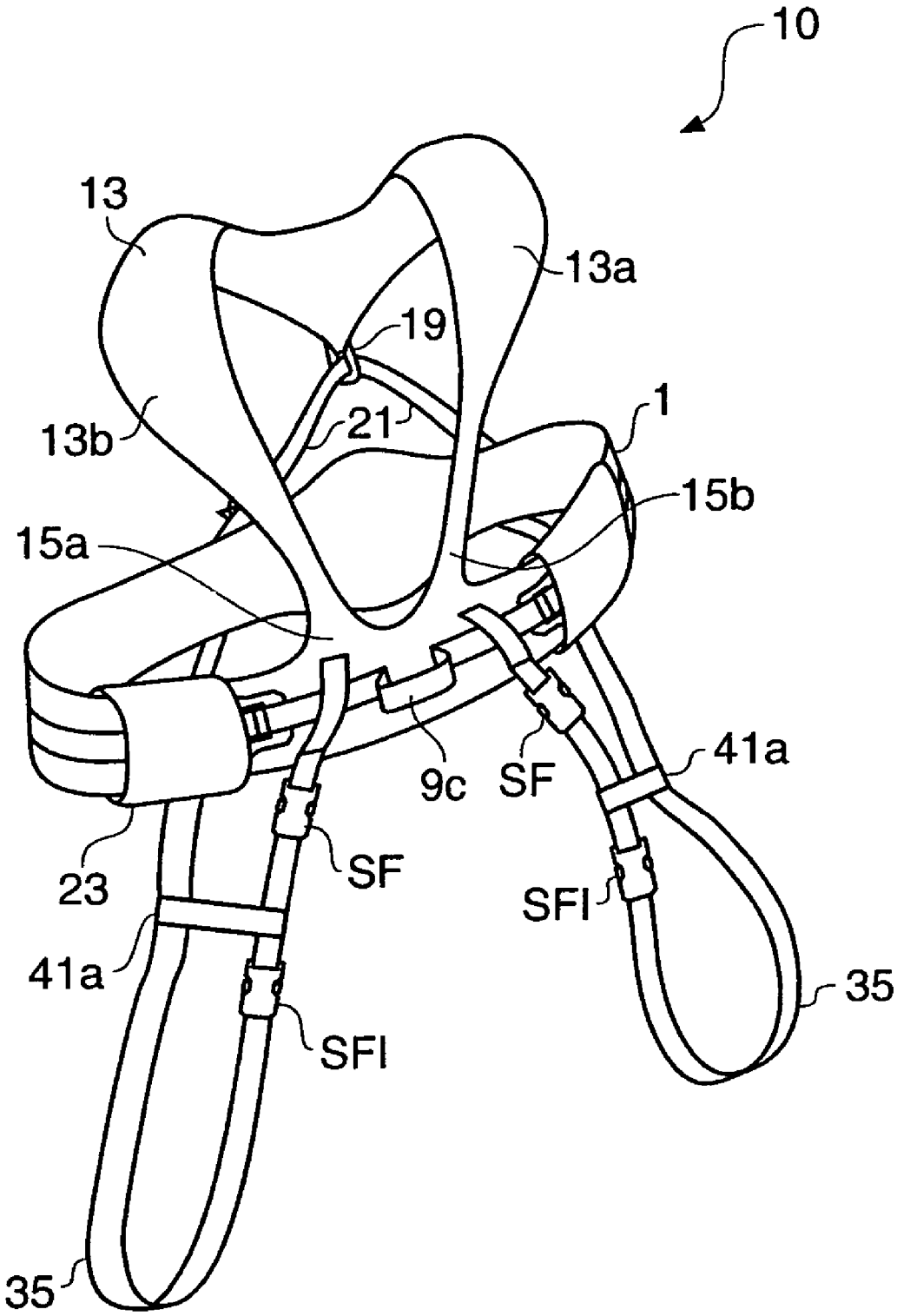
FIG. 1*b* illustrates a deck harness with thigh straps and a bridge section.

Referring to FIGS. 1*a* and 1*b* thigh straps 35 may be connected to the chest belt 1 by means of strap 37*a* and strap 37*b* extending downward from the front 3 and rear 5 sections respectively. Each of the straps 37*a*, 37*b* has affixed to its free end complementary parts of a snap-fit fastener SF; the thigh straps 35 having the complementary snap-fit fasteners SF to attach them to the chest belt 1. Each thigh strap 35 may include a loop attachment 41 (see FIG. 1*a*) through which a free end of the thigh strap 35 passes to hold the thigh strap 35 in a comfortable position for the wearer. Preferably, the loop attachments 41 are each fixed, e.g. stitched at one side to the thigh strap 35.

Alternatively, the thigh straps 35 may include a bridge strap 41*a* (see FIG. 1*b*), which bridges two points, front and rear, of the thigh strap 35, forming a leg loop below the bridge strap 41*a*. The bridge strap 41*a* is fixed in place, by stitching or other suitable manner.

For ease of donning and adjustment, an additional snap-fit fastener SF1 may be attached at a point along the length of the thigh strap; preferably, located below the loop attachment 41 or bridge strap 41*a* and to the front, when worn, such that a loop is formed around the wearer's thigh. The snap fit fastener SF1 also facilitates adjustment of the leg loop size to suit the wearer.

It will be appreciated that when the loop attachment 41 is used the snap fit fastener SF1 may not be required, because one end of the thigh strap freely passes through the loop attachment 41; therefore, the snap fastener SF allows adjustment of loop size. In this example, when the deck harness 10 is worn the thigh strap 35 may be formed from a single length of strap having the loop attachment 41 attached close to one end; preferably, at the rear. The rear section of the thigh strap 35 connects to the snap-fit fastener SF on the end of strap 37*b* extending from the rear section 5 and the free end passes around the outer thigh of the wearer and through the loop attachment 41 before snap-fitting into the snap fit fastener SF provided on the end of strap 37*a* to encircle the legs of the wearer.

When worn the bridge strap 41*a* is preferably located on the wearer's hip to improve comfort. Straps 37*a* and 37*b* provide positional adjustment, of the bridge strap 41*a* or the loop attachment 41.

Figure 7:
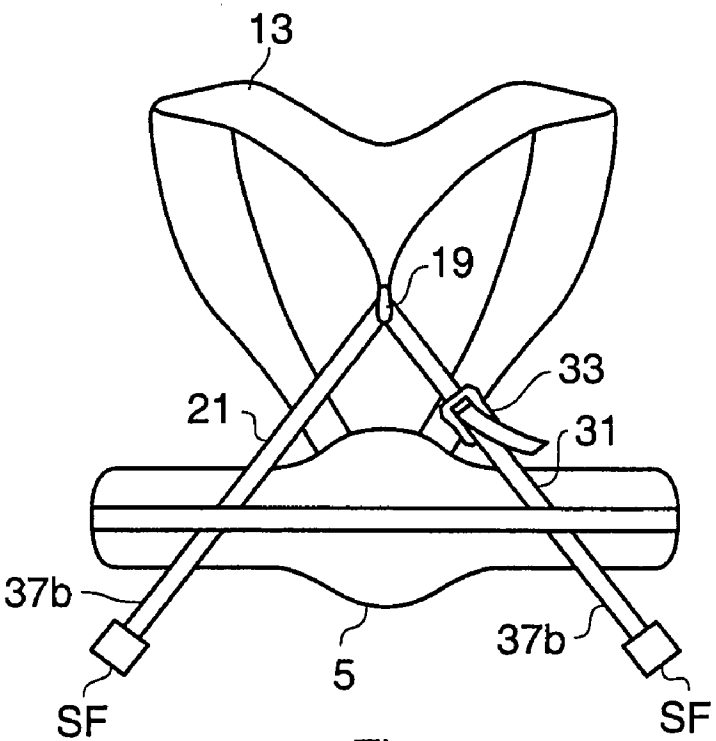
FIG. 7 represents a rear elevation of the deck harness as worn.
Figure 6A:
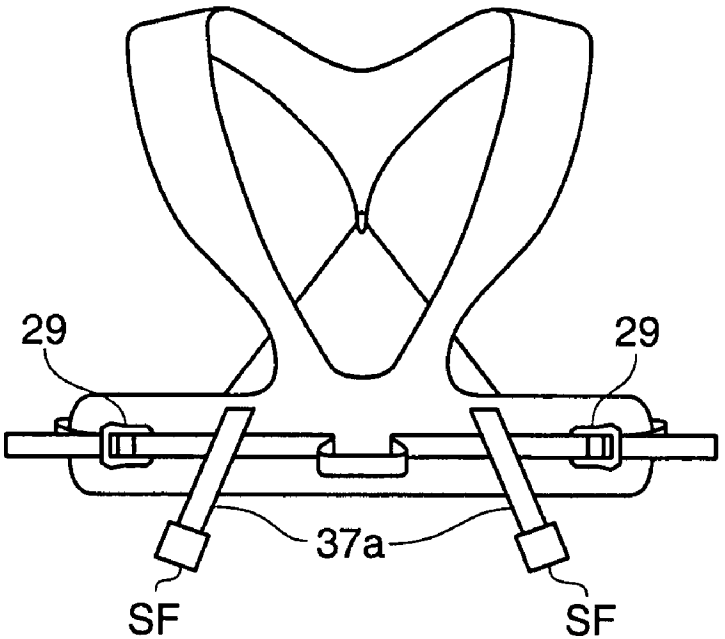
FIG. 6(*a*) represents a front elevation of the deck harness as worn.
Figure 6B:
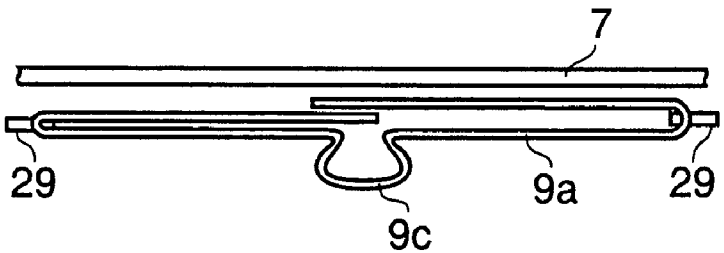

As shown in FIGS. 6A and 7, the thigh straps 35 are attached to the chest belt at an angle which, in use of the thigh straps 35, brings the loop attachments 41 to the outer hips of the user. The thigh straps 35 may be in sections joined by releasable snap fit fasteners SF1. The strap sections cooperate with the loops 41 to encircle the thighs of the user.

Thigh straps 35 act as a retainer to retain the harness, when worn, in a comfortable and safe position on the torso. The thigh straps 35 also prevent ride-up.

Straps 37*a* overlap the outer portion 9 to facilitate connection of a life jacket, as described below.

Leg Straps

Figure 1D:
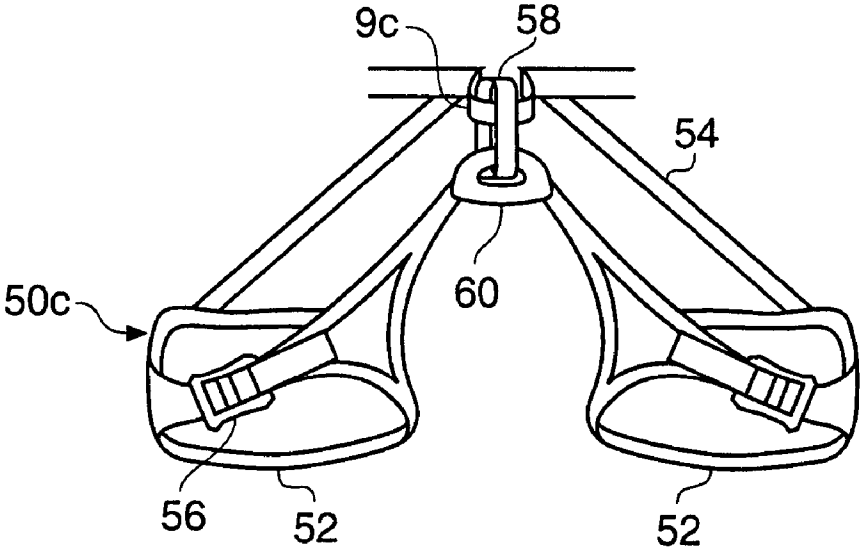
FIG. 1*d* illustrates another example of leg straps for attaching to harness of FIG. 1*a;*
Figure 1E:
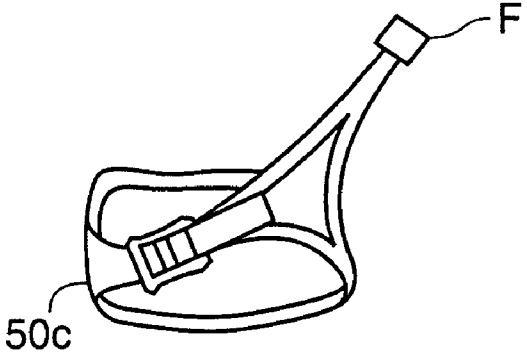
FIG. 1*e* illustrates an example of leg straps being connected individually to the harness of FIG. 1*a;*
Figure 1C:
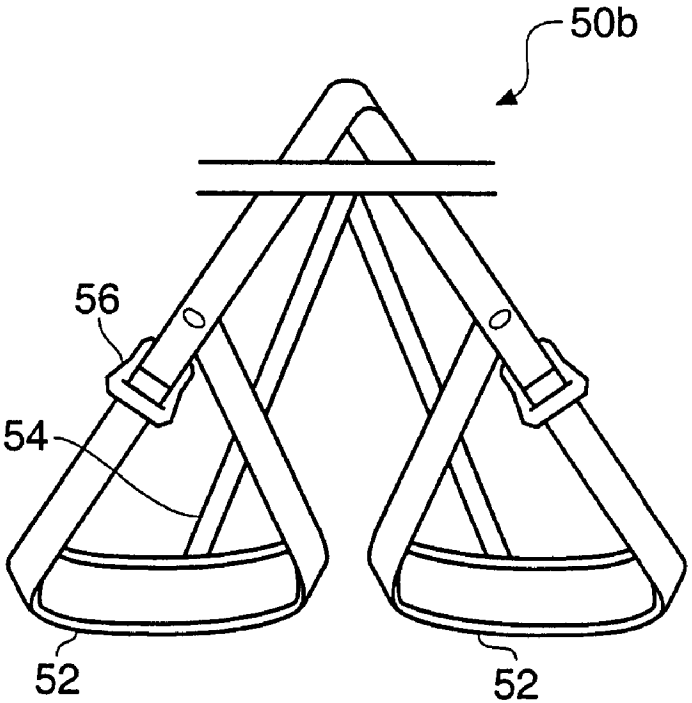
FIG. 1*c* illustrates an example of leg straps for attaching to harness of FIG. 1*a* to provide a mast harness.

Referring to FIGS. 1*c* and 1*d*, leg straps 50*b* and 50*c* may be provided instead of the thigh straps 35 so that the harness is useable as, for example, a mast harness. When used as a mast harness the leg straps 50*b* and 50*c* support the weight of the user whilst working aloft. Each leg strap 50*b* and 50*c* is designed such that it will be load bearing whilst the wearer works aloft, for example, on the mast, whereas thigh straps 35 are not intended to be load bearing and act as a retainer and provide added security when wearing the harness as a deck harness to ensure the deck harness cannot slip off. The leg straps 50*b* and 50*c* may be connected to the belt section of the deck harness 10 in a similar manner to the thigh straps 35 as described above. The rear section 52 of the leg strap 50*b* and 50*c*, which is in contact with the back of the thigh, when worn is required to be of a suitable width to bear the weight of the user and to provide reasonable comfort whilst working aloft. Examples of suitable leg straps are illustrated in FIGS. 1*c* and 1*d*. Alternatively, or in addition, the leg straps may be provided by multiple straps (not illustrated) displaced along the back of the thigh providing support along a wider area, whilst providing a collapsible compact arrangement for stowage when not worn. An example of suitable leg straps 50*b* illustrated in FIG. 1*c* shows a simple strap system having a reinforced and widened portion at the rear section 52. The reinforced, widened portion being in contact with the back of the thigh when worn.

Another example of suitable leg straps 50*c* illustrated in FIG. 1*d* has a laminate construction as described below, in relation to the inner loop. The edging that is applied is not only decorative but also provides vital load bearing capacity to the leg straps 50*c*. The two examples 50*b* and 50*c* also vary in the manner they are attached to the safety harness. Leg straps 50*b* are sewn into the front and rear sections of the chest belt. Leg straps 50*c* are connected to each other by a loop 60 which is attached to the anchorage point 9*c* provided at the front of the chest belt by means of another loop 58.

Both examples 50*b* and 50*c* include straps 54 that extend from the rear of the leg straps 50*b* and 50*c* and connect to the rear belt section. The leg straps 50*b* and 50*c* illustrated in FIGS. 1*c*, 1*d* and 1*e*, each comprise a removable anti-abrasion cover (not illustrated) to protect the leg straps 50*b* and 50*c* from deck abrasion. Each leg strap 50*b* and 50*c* also includes a metal fastener 56 for adjusting the straps to fit the wearer. That, for example, ensures that the leg straps 50*b* and 50*c* can be secured tightly around the wearers legs when working aloft.

By replacing the thigh straps 35 with leg straps 50*b*, 50*c* facilitates the use of a deck harness as a mast harness. It will be appreciated that the snap-fit fasteners SF described above for attaching the thigh straps 35 may not be suitable for load bearing application such as is required when using leg straps 50*b*, 50*c*. Therefore, when the application of the harness is to be multifunctional, for example a deck harness and mast harness combined, the leg straps 50*b*, 50*c* will be used in place of the thigh straps 35. A suitable load bearing fastener F would be provided at a suitable location on the chest strap or ends of straps 37*a* and 37*b* to receive corresponding fasteners F located on the leg straps (see left hand leg strap illustrated in FIG. 1*e*).

Fasteners

The fasteners 29, 33 each comprise two metal loops pivoted together at one side. A strap passes through the centre of both loops and between the two loops where it is trapped. The metal loops may be of marine grade stainless steel, titanium or any other suitable marine grade material Inner Loop The inner loop comprises a laminate structure having an inner layer, in contact with the torso of the wearer, an outer layer, which is exposed to the weather and elements and sandwiched between the inner and outer layers there is a padding layer. The inner portion 7 provides the required minimum width of the belt required by certification. It provides spreading of the load applied to the webbing forming the outer portion 9 allowing the outer portion to be narrower than the 45 mm required by certification. The inner portion provides a thicker softer and thus more comfortable fit to the user than a conventional harness made only of webbing.

Materials

In a preferred embodiment, the webbing of the outer portion 9 and of the thigh straps 35 is of polyester. The edging 17 is also of polyester. The stitching is of polyester. The inner loop and the shoulder straps are of laminate comprising a core of closed cell polyethylene foam laminated to outer layers of polyester. The layer of polyethylene foam provides an element of buoyancy to the deck harness. It will be appreciated that any other suitable materials may be used.

Flotation Aid

Referring to FIGS. 8 to 11, the harness may be used with a flotation aid.

The flotation aid may include the thigh straps or leg straps as described above.

A conventional life jacket comprises an inflatable generally U-shaped bladder, which has one or more $CO_2$ gas cylinders actuated by an actuator to inflate the bladder. The actuator in the present example is actuated manually in known manner by pulling on a string S. In other examples the actuator responds automatically to contact with water. The life jacket is housed in a protective cover 40. Provision of such a cover is conventional. The cover is generally U shaped and has a zip Z along its outer edge. When the life jacket inflates the zip breaks along the entire edge without the user needing to open the zip. The life jacket and cover as so far described is entirely conventional. The cover of FIGS. 8 to 11 differs from a conventional cover in the following respects:

a) it is modified to attach to the safety harness of FIGS. 1 to 8A;

b) it has an improved device for manually actuating the actuator.

Figure 8A:
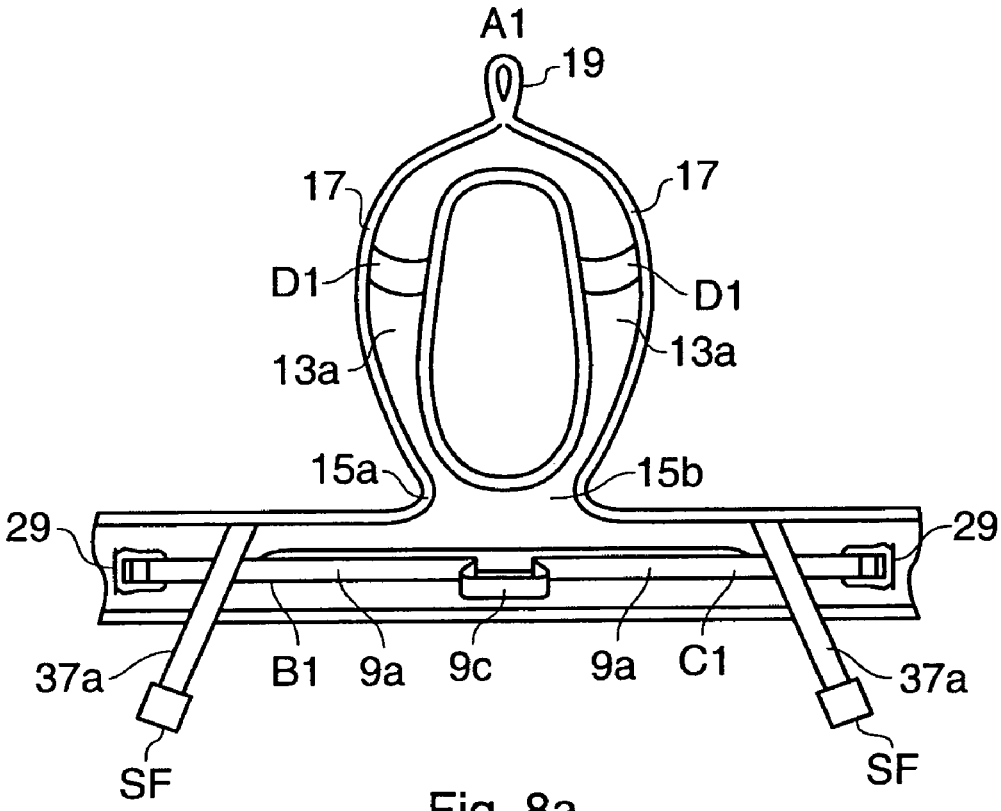
FIG. 8A is a partial front view of the safety harness in a partly disassembled state.

The cover 40 of the present embodiment has means for attaching it to the safety harness of FIGS. 1 to 8A. In this example those means are loops A2, B2 and C2 fixed to the cover. The loops A2 and B2 are fixed to the free ends of the arms of the U-shaped cover 40. The loop C2 is fixed to the midpoint of the cover. To attach the cover 40 to the safety harness, the harness is partly disassembled as shown in FIG. 8A. The loop 19 is released from the strap 21. The fasteners 29 of the strap 9*a* are released and moved through openings between the thigh straps 35 and the inner portion 7. The loop 19 is passed through loop A2 of the cover at A1. The loop 19 is then reattached to the strap 21. The fasteners 29 of the chest belt are passed through the loops B2 and C2 at the ends of the arms of the cover 40, The fasteners 29 are then passed beneath the thigh straps 35 and fasteners 29 linking the sections of the outer strap are reassembled. Thus loops B2 and C2 are fixed to the strap 9*a* at positions B 1 and C1 between the thigh straps 35 and the tether attachment 9*c*.

Preferably, to ensure the cover and life jacket are closely attached to the harness, the cover has on the back thereof at the midpoints of the two arms, adjustable straps D2 which pass through corresponding loops D1 on the shoulder straps 13*a* and 13*b* as shown in FIG. 8A.

Integral Cover and Yoke

Another way of ensuring that the cover and life jacket are closely attached to the harness is by providing the cover as an integral component of the yoke strap. This is achieved by manufacturing the yoke strap with an additional layer of material, with one open edge, which will have a zip fastener attached to form a zipped housing within which the life jacket is housed.

The shape of the yoke results in a life jacket that has a distinctive appearance and provides comfort to the wearer. The area where the yoke and front section of the deck harness come together is very compact and provides for a semi-rigid support about the shoulders and body whilst allowing the wearer freedom of movement about the torso and arms.

Manual Release for Inflating the Lifejacket

Figure 8B:
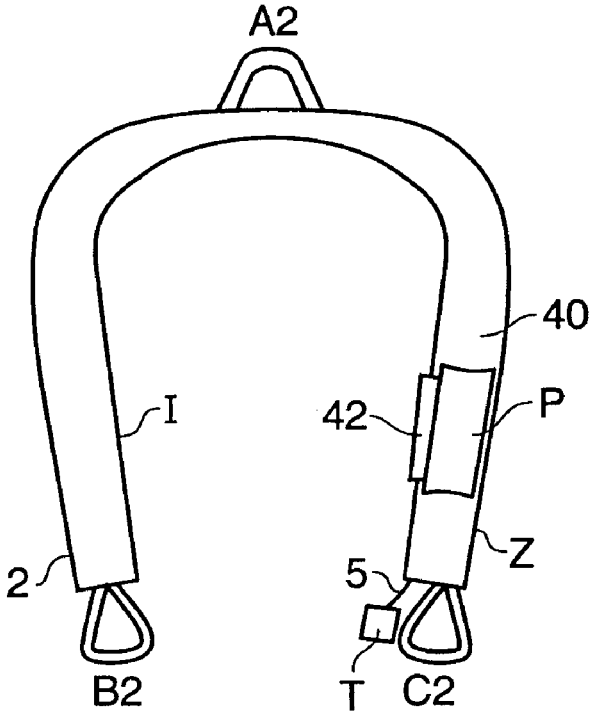
FIG. 8 B is a front view of a lifejacket in a cover; the cover being for use with the harness of FIGS. 1 to 8.
Figure 9:
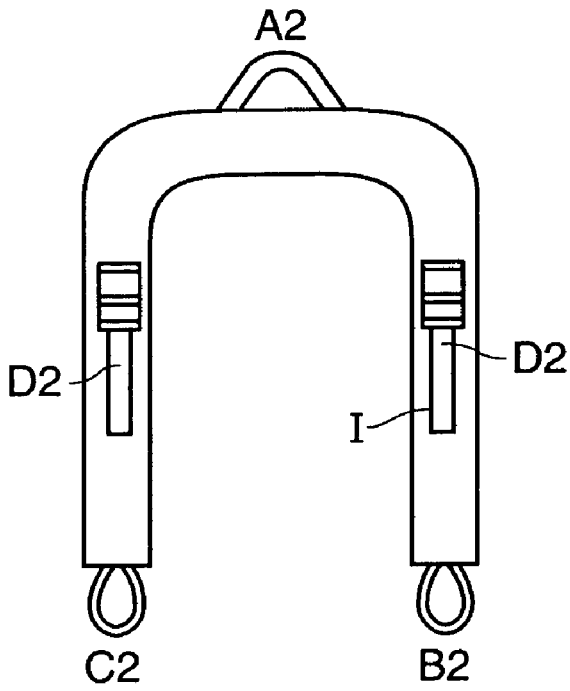
FIG. 9 is a rear view of the cover of FIG. 8B.

Referring to FIG. 8B, a conventional life jacket has a string attached to a toggle T or the like for manually actuating inflation of the lifejacket. A toggle T is widely used. The toggle is small and difficult to locate in an emergency, for example when a user has accidentally fallen into the sea. Also the toggle T usually hangs down from the string S at the bottom of one of the arms of the cover. The string S attaches to a trigger of the actuator, which releases the gas in the cylinder to inflate the life jacket. The toggle may catch on equipment on a boat causing the lifejacket to inflate unnecessarily. Thus users may put the toggle inside the cover making it even more difficult to use in an emergency. Furthermore the position of the toggle is inconsistent; its position may depend on how the life jacket is packed into the cover.

The examples of the cover and lifejacket described above may use such a string and toggle. However, in accordance with another aspect of the present invention, a different arrangement is preferred.

Figure 10:
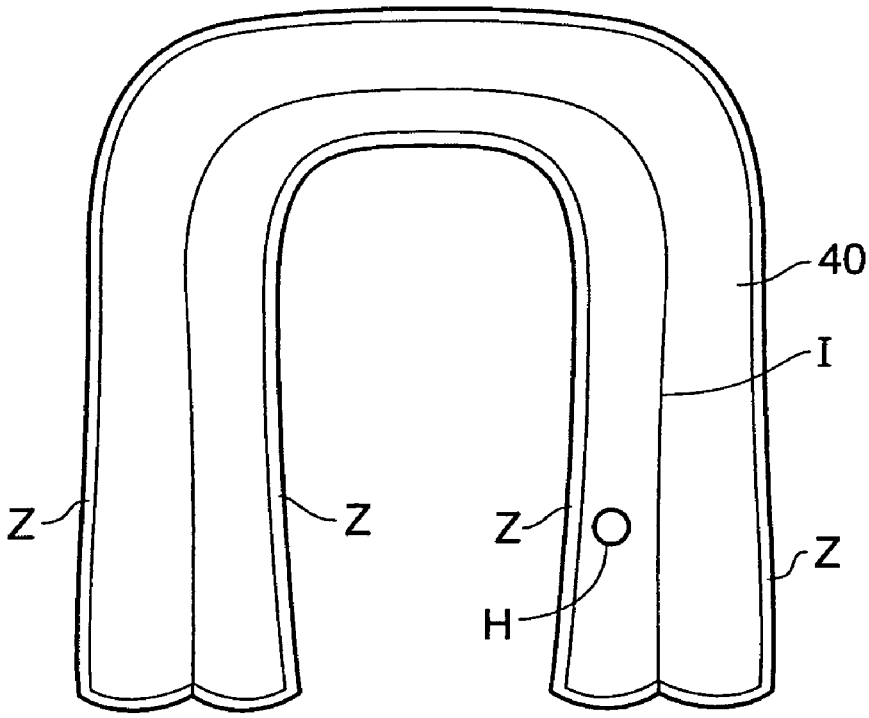
FIG. 10 shows the cover opened out.
Figure 11:
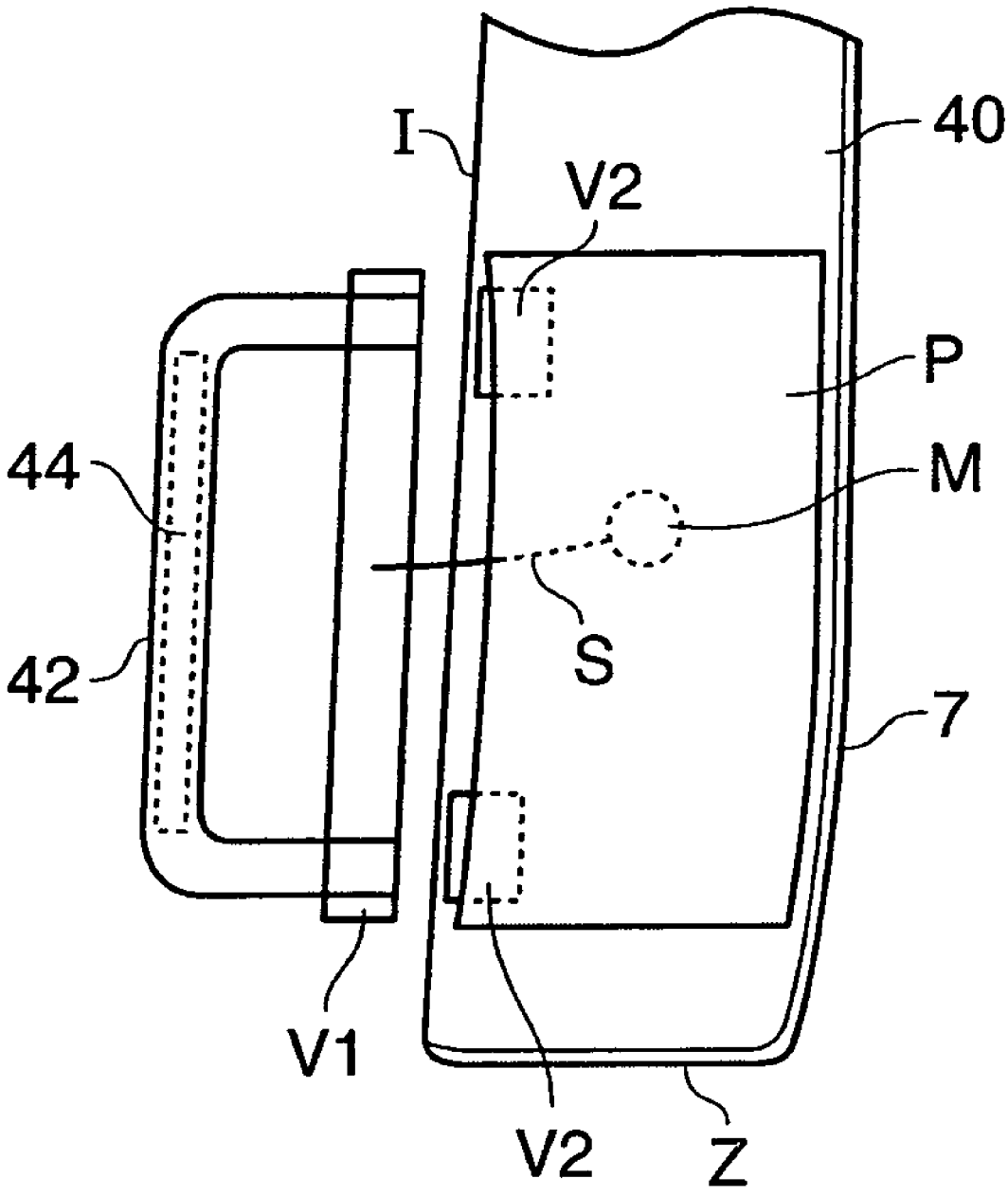
FIG. 11 shows a detail of the cover of FIG. 8.

Referring to FIGS. 10 and 11, FIG. 10 shows, schematically, a cover which has been unzipped. FIG. 10 shows the cover has two U shaped parts stitched together along the inner edge I of the cover and having a zip Z (or two zips) on the outer edge. As shown in FIG. 10, a hole H is provided in the front of the cover. The hole may be a simple round hole in the material of the cover, or may be a short tube or some other aperture. Its purpose is to allow the string S to pass through the cover. As shown in FIG. 11, the hole communicates with the inside of a pocket P stitched or otherwise fixed to the outside of the front cover. The pocket has an opening adjacent the inner edge I of the cover. The pocket is at about the chest of a user when in use. The string S is attached not to a toggle as is conventional, but to a handle 42. The length of the handle is about the width of a hand. The handle and the edge of the pocket are provided with hook and loop fastening V1 and V2, for example Velcro (Trade Mark) to hold the handle in the edge of the pocket but protruding therefrom as shown in FIG. 8B. This arrangement has the advantage of providing:

a handle which is easy to locate because it is large relative to a toggle, a handle which is in a consistent position in all examples of the cover and thus easy to locate;

a handle which, because it is located parallel to the inner edge of the cover away from the free end of the cover, is protected and unlikely to catch accidentally on equipment, minimising the risk of accidentally inflating the life jacket.

The handle 42 in the example shown in FIG. 11 comprises a tube of fabric, for example polyester fabric, containing a stiffener 44, which may be for example a plastic tube or a length of rope. The fabric is stitched to a length of hook fastener material V1. The string S is attached to the hook material V1, being tied to that material, or it may be tied or otherwise fixed elsewhere to the handle. Patches of loop fastener material V2 are provided inside the pocket P adjacent the inner edge I of the cover to attach to the hook material V1 of the handle.

It will be appreciated that the handle could have many other forms. In another example the handle is of plastic.

Preferably the handle has a colour which is easily visible and contrasts with the colour of the cover adjacent to the handle. In one example the handle is black and at least the portion of the cover adjacent the handle, for example the inside of the pocket, is a bright colour. Bright orange and red are examples of suitable colours.

Whilst it is not essential to modify the life jacket for use with the handle and modified cover shown in FIG. 11, it is preferable to locate the gas cylinder for inflating the life jacket and its actuator at a position which corresponds to that of the pocket to provide a convenient route for the string S. The pocket may be placed at any convenient position along the inner edge of the cover preferably high on the chest of the user so in use in the water it is not underwater.

It will be appreciated that the modified cover of FIGS. 10 and 11 together with the handle may be used with a cover separable from the yoke of the harness or with a cover/housing, which is integral with the yoke.

It will be appreciated that the modified cover of FIGS. 10 and 11 together with the handle may be used with a life jacket independently of use with a harness as shown in FIGS. 1 to 8A. The cover of FIGS. 10 and 11 and the handle are considered to be inventive independently of the harness.

Integral Life Jacket and Yoke

In the example given above the life jacket is housed in a cover separate from the life jacket. The cover protects the life jacket from abrasion and the effects of UV light which can degrade the life jacket. However a known form of life jacket does not have a cover. Such a life jacket has at least an outer covering, which is more resistant to abrasion and UV light than the type, which requires a cover. In one example of the invention, such a life jacket is an integral part of the yoke 13, being fixed to it by suitable means.

Figure 12:
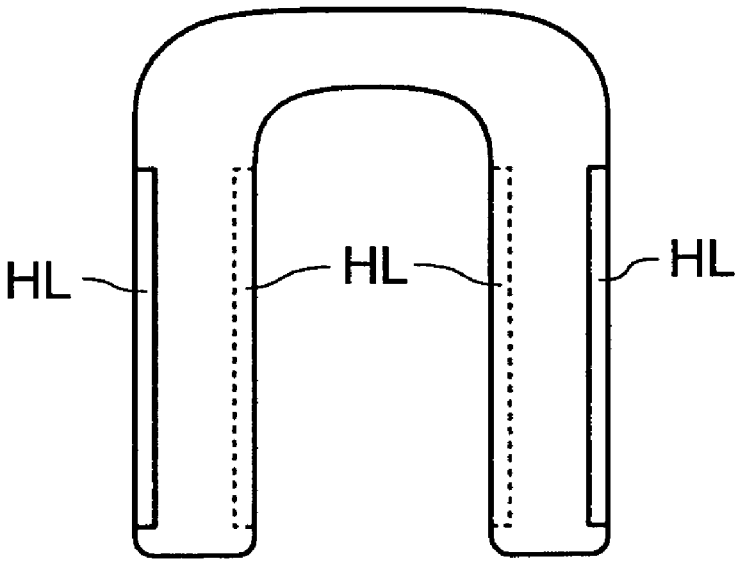
FIG. 12 shows an example of an integral life jacket.

Referring to FIG. 12 an example of such a life jacket is generally U-shaped. The two arms of the jacket have hook and loop fastening material e.g. Velcro (Trade Mark) along the edges thereof so that the arms can be folded along their length and the folded edges held together by the fastening material HL to reduce the bulk of the jacket when un-inflated.

Other Types of Life Jacket

Figure 13:
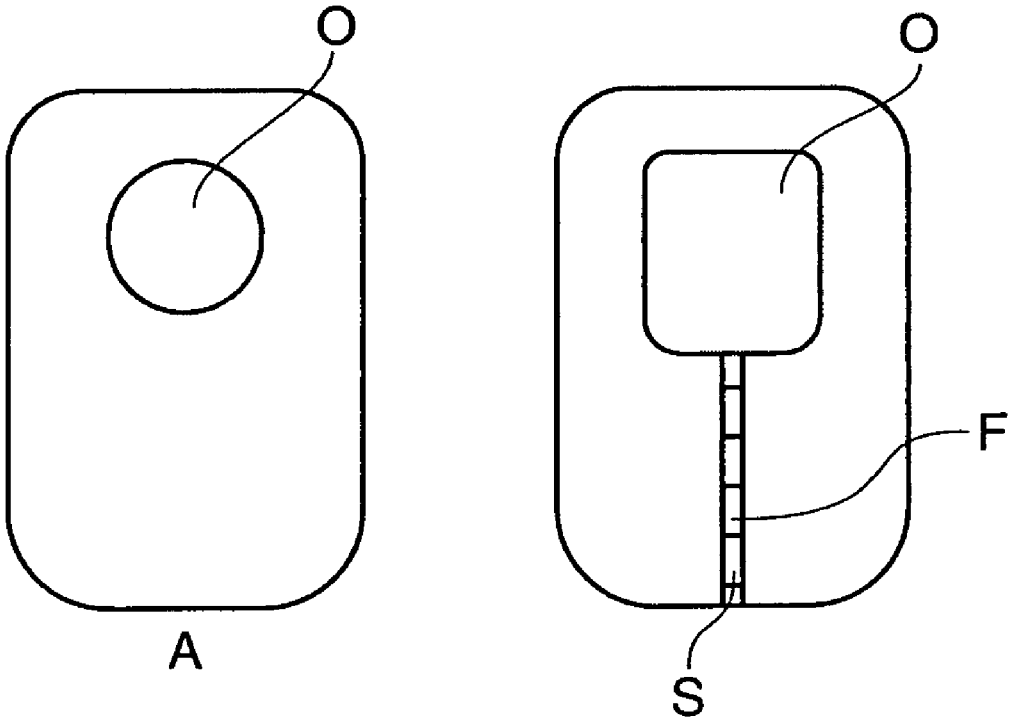
FIG. 13 shows examples of life jackets for use with harness of FIG. 1*a*.

In the foregoing description, examples of life jackets have been given, all being of generally U-shape. However the invention may be used with other types of life jacket examples of which are shown in FIG. 13. In the example of FIG. 13A, the life jacket has a generally rectangular bladder having an aperture 0 through which the user passes their head. The example of FIG. 13B is similar except the jacket is split S beneath the aperture to make it easier to don. The split has a fastener F for securing the jacket once it is donned.

Figure 14:
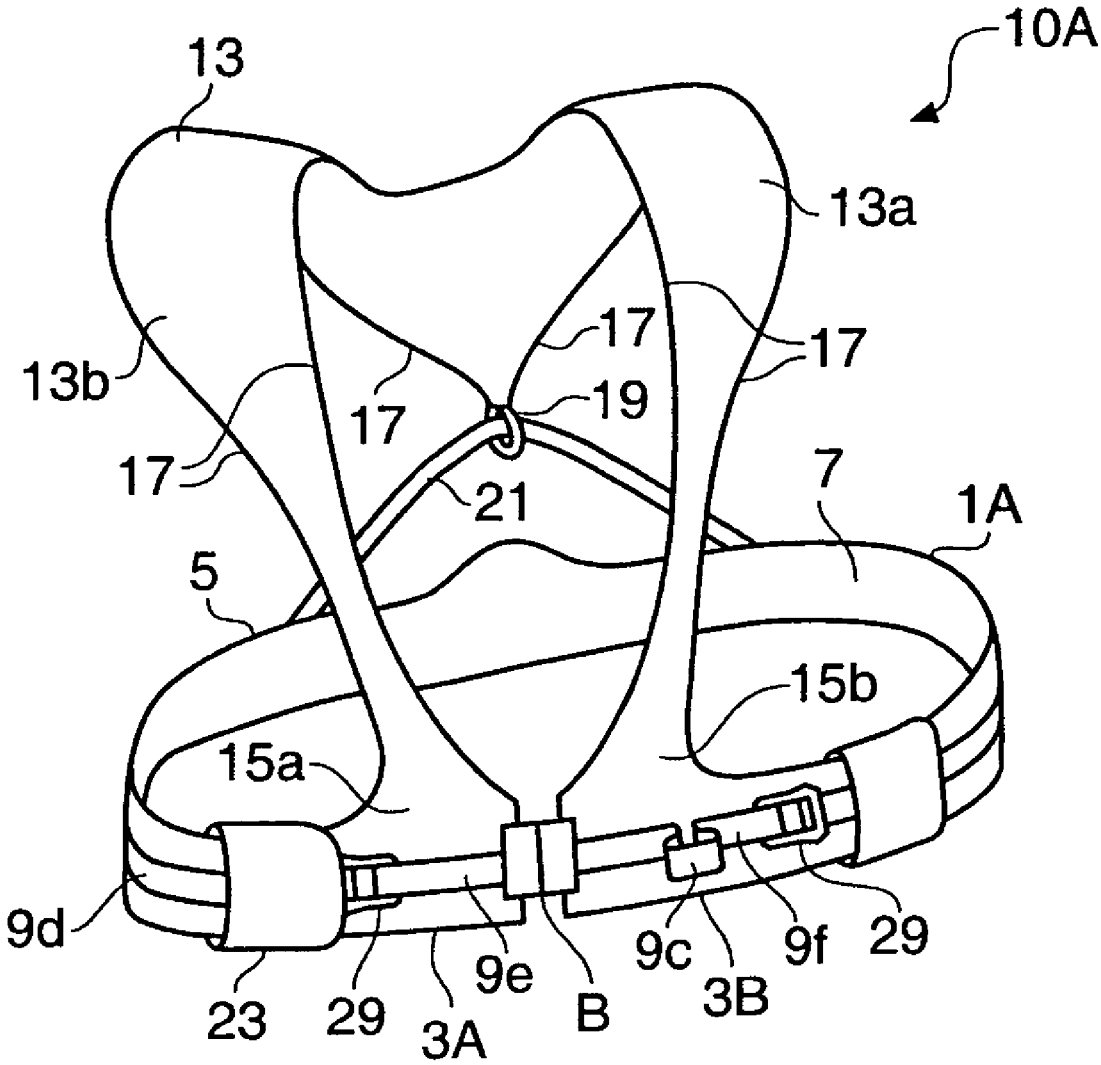
FIG. 14 shows an alternative harness to that illustrated in FIG. 1*a*.

Alternative Example of a Harness—FIG. 14

Figure 3:
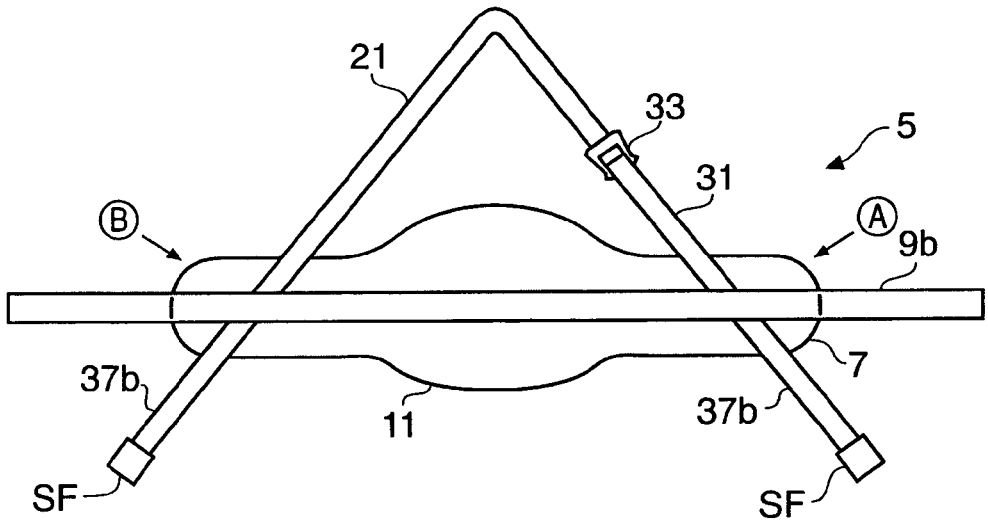
FIG. 3 illustrates a rear section of the deck harness of FIG. 1*a;*

FIG. 14 uses the same references as FIGS. 1 to 3 for like features of the harness.

Referring to FIG. 14, another aspect of the present invention provides a harness 10A, which is similar to that described above but differs in that the belt 1A is has a buckle B or other suitable fastener at the front central area enabling the harness to be donned in the manner of a jacket. Also the tether attachment 9*c* is placed to one side of the buckle B. The harness may be used as a deck harness, a mast harness, and/or a life jacket as described above incorporating some or all of the features of the examples of the invention described above.

In more detail the harness comprises a chest belt 1 formed of two parts; namely a front section 3 and a rear section 5. The front section 3 and rear section 5 each comprise two portions; namely an inner portion 7 and an outer portion 9. The front section 3 in turn is divided centrally into two sections 3A and 3B joined by the buckle B. When the two sections 3A and 3B are joined by the buckle B the inner portion 7 is effectively a complete loop. At the divide, the edges of the inner portion 7 and the outer portion 9 abut one another thereby providing and effectively complete loop of padding between the load bearing outer portion 9 and the body of the wearer.

The inner portion 7 has a minimum width of 45 mm. The front section 3 of the inner portion 7 as shown in the figures has a minimum width of 50 mm at its narrowest part; namely, at the ends thereof. Generally, a width of 70 mm applies over the major part of the front section.

The rear section 5 of the inner portion 7 as shown in the figures has a width of generally 50 mm increasing to a maximum of 95 mm about the central section.

The inner portion 7 is shaped to fit comfortably against the human body. At the rear section it is shaped to provide a larger contact surface 11 in the region of the spine to provide added comfort to the wearer.

The front section 3 is formed with an integral yoke 13, having two shoulder straps 13*a* and 13*b* and which passes around the neck of the wearer and is supported on the shoulders. The transition from chest belt 1 to each shoulder strap is in a delta formation 15*a*, 15*b*. Each delta formation is a generally triangular transition. The two delta formations 15*a*, 15*b* space apart the connections of the shoulder straps 13*a*, 13*b* to the chest belt to provide a comfortable fit for the user. The delta formations allow the shoulder straps to connect to the chest belt at a three-way connection at desired angles to provide a comfortable fit for the user.

The inner portion 7 of each of the front sections 3A and 3B and the adjoining part of the yoke 13 may be manufactured in one or more pieces. They have a padded form with breathable material forming the inner surface, which is in contact with the body of the wearer when worn, and substantially water repellent and/or abrasion resistant material forming the outer surface. A preferred form of the material is a laminate having a closed cell foam core laminated on one side with the breathable material and laminated on the other side with the abrasion resistant material. The entire piece is edged with fabric edging material 17, which provides much of the strength of the yoke whilst also providing a radiused softer edge to the harness. The edging 17 at the yoke section 13 extends to form a loop 19 through which a strap 21 passes to facilitate adjustment to the rear of the deck harness when worn.

Each shoulder strap is connected to the delta formation of the chest belt by the edging material 17, which bears the required load.

In the example of FIG. 14, a tether attachment 9*c*' is to one side of the buckle B at the front centre of the chest belt. The tether attachment may be at any other suitable position. The front sections 3A and 3B each further comprises a tunnel section 23 (see FIGS. 1 and 5), which acts as a guide to bring the front 3 and rear section 5 into overlapping contact when adjusting the chest belt 1 to fit the wearer. The tunnel section 23 also prevents twisting of the chest belt 1 during donning. As shown in FIG. 14 there are two tunnel sections, one at each side of the harness. The tunnel sections may be used to stow tether when it is not deployed to attach the user to the boat. Preferably the tunnel sections are of elasticated material.

Elastic straps 27 (see FIGS. 2 and 4) join together the front 3 and rear 5 sections of the inner portion 7 to form a continuous loop. The elastic straps 27, in their unstretched state, hold the front 3 and rear 5 sections in overlapping relation. On donning, the elastic straps 27 yield to increase the size of the inner loop, thereby easing donning of the deck harness 10.

Fabric straps 9*d*, 9*e* and 9*f* attached to the outer surface of the inner portion 7 provide the outer portion 9. The straps are of webbing of any suitable material. Preferably the webbing is of polyester. The outer portion 9 is the main load-bearing member of the harness.

At the rear section 5 the fabric strap 9*d* extends from both ends towards the front section 3. At the front section 3 the strap 9*f* is adapted to provide the loop 9*c* to which a tether (not shown) may be attached. Additionally, at the front section two fasteners 29 are fixed to the strap 9*a*, each being disposed about the centre and connecting the front strap sections 9*e* and 9*f* to the strap 9*d* extending from the rear section 5. The fasteners 29 are held by loops formed by the strap sections 9*e* and 9*f*. The tether attachment loop 9*c* is an integral part of the strap 9*f*. The buckle B has two parts one connected to a loop of strap section 9*e* and the other connected to a loop of strap section 9*f*. When the buckle B is fastened, the connection of the rear section strap 9*d* via the fasteners 29 to the front strap 9*e* and 9*f* and the connection of the front straps 9*e* and 9*f* by the buckle B provides a continuous outer loop, which is the load bearing loop. The fasteners 29 facilitate adjustment of the chest belt 1 of the harness 10 to fit the wearer.

An additional strap 21 and fastener 33 arrangement at the rear of the harness 10 provides adjustment of the distance between the yoke 13 and the rear section 5 to fit the wearer. The combination of strap 21 and fastener 33 forms an inverted V. Two straps 21, 31 are fixed to the rear section, each being disposed about the centre. One strap 21 extends from the rear section 5 and passes through the loop 19 at the yoke 13 to be connected with a fastener 33 affixed to the free end of the other strap 31.

The harness of FIG. 14 may further comprise any of the other features of the harnesses shown in FIGS. 1 to 13.

It will be appreciated that the buckle B or other fastener may provide the adjustment of the size of the belt 1A in which case one or both of the fasteners 29 may be omitted. If both fasteners 29 are omitted the outer loop comprises a single piece of webbing extending from one side of the buckle to the other side of the buckle.

It will be appreciated that various types of marine safety harnesses have been described herein; namely, deck harness, mast harness and life jacket. Safety features such as the anchorage point, thigh straps and life jacket help distinguish one harness type from the other. However, it will also be appreciated that many of the features of the embodiments of the present invention herein described could be combined to provide a multifunctional harness having the qualities of a deck harness, mast harness and life jacket in one. Likewise, all or some of the safety elements may be omitted to provide a safety harness to fit certain criteria, such as flotation and/or tethering to the deck, and/or supporting a wearer whilst working aloft.

The invention claimed is:

1. A safety harness to be donned in the manner of a jacket, comprising:

an inner portion contactable with an area of the body of a wearer between the waist and the chest when worn;

an outer load bearing strap fixed to the inner portion; and a first fastener located at the front of the harness and common to the inner portion and the outer load bearing strap, the inner portion and the outer load bearing strap each forming a complete loop when the first fastener is fastened, the inner portion having at least one resilient section located in a respective guide tunnel for preventing twisting of the resilient section, wherein the resilient section is arranged to yield within the respective guide tunnel to increase the size of the loop formed by the inner portion;

the outer load bearing strap comprising a further adjustable fastener being adjustable to facilitate adjustment of size of the complete loops formed by the inner portion and the outer load bearing strap to fit the wearer and wherein the first fastener common to the inner portion and the outer load bearing strap is arranged to break the complete loops of the inner portion and the outer strap when it is unfastened.

* * * * *